US006290227B1

(12) United States Patent
Reist

(10) Patent No.: US 6,290,227 B1
(45) Date of Patent: Sep. 18, 2001

(54) CLAMP FOR HOLDING FLAT OBJECTS

(75) Inventor: Walter Reist, Hinwil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/555,180

(22) PCT Filed: Sep. 21, 1998

(86) PCT No.: PCT/CH98/00406

§ 371 Date: May 22, 2000

§ 102(e) Date: May 22, 2000

(87) PCT Pub. No.: WO99/30997

PCT Pub. Date: Jun. 24, 1999

(30) Foreign Application Priority Data

Dec. 17, 1997 (CH) ..... 2901/97

(51) Int. Cl.[7] ..... B65H 5/02

(52) U.S. Cl. ..... 271/277; 271/3.24; 271/204; 198/803.8; 414/753

(58) Field of Search ..... 399/304; 414/796.9, 414/753, 941, 206; 101/408; 198/470.1, 867.06, 867.02, 803.8; 271/3, 24, 277, 204

(56) References Cited

U.S. PATENT DOCUMENTS 4,526,363 * 7/1985 Fort ..... 271/268 X
4,534,843 * 8/1985 Johnson et al. ..... 204/202 X
4,583,727 * 4/1986 Fort ..... 271/19 X
4,721,296 1/1988 Mowry .
4,779,717 10/1988 Eberle .
5,222,727 * 6/1993 Jaclbsen ..... 271/205 X
5,755,436 5/1998 Reist .

OTHER PUBLICATIONS

International Search Report for PCT/CH98/00406, Dec. 23, 1998.

* cited by examiner

*Primary Examiner*—Christopher P. Ellis
*Assistant Examiner*—Kenneth W Bower
(74) *Attorney, Agent, or Firm*—F. David AuBuchon; Brinks Hofer Gilson & Lione

(57) ABSTRACT

Both limbs of the clamp (2, 3), which are pivotally arranged on the axis of a bearing, are rotated from a closing position into an open position and vice versa by an actuating device (12). The actuating device (12) can be displaced from a top end position (13) to a lower end position (14). The actuating device (12) exerts a closing or clamping force on the outer side (22, 23) of the limbs of the clamp (2, 3) in said lower end position (14). When the actuating device (12) is displaced to the top end position (13), an expanding element (15) arranged between the limbs of the clamp (2, 3) comes into contact with the inner side (24, 25) of the limbs of the clamp (2, 3) and exerts an opening force on the limbs of the clamp (2, 3) so that said limbs (2, 3) are swung at a large angle ($\alpha$) in their open position.

13 Claims, 4 Drawing Sheets

CLAMP FOR HOLDING FLAT OBJECTS

Figure 2:
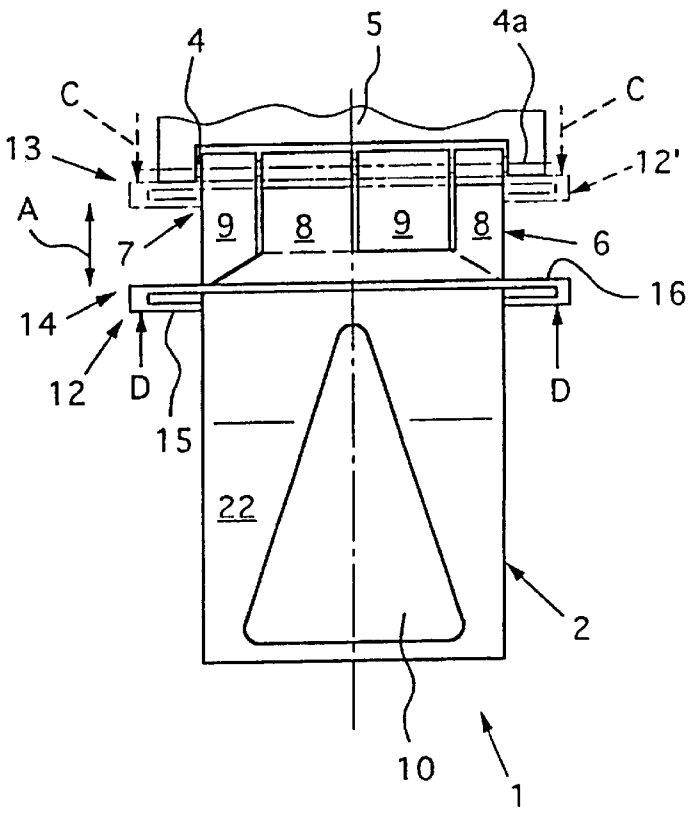

The present invention relates to a clamp for retaining sheet-like articles, in particular flexible articles such as printed products containing one or more sheets, according to the preamble of claim 1 and to a conveying apparatus having a number of such clamps for conveying a product formation.

A known clamp of this type, as is disclosed in EP-A-0 767 125, has two clamp legs which are mounted rotatably on a bearing spindle. These clamp legs are retained in a closed position by a closing device which receives the clamp legs between it. Upon pivoting or a translatory movement of the closing device, the clamp legs can be pivoted away from one another into their open or release position. In order to influence the movement of the clamp legs into the open or release position, there is provided a compression spring which is arranged between the clamp legs and subjects the clamp legs to a spreading force and thus retains the clamp legs in a given open position. However, the design of these previously known clamps means that the clamp legs can only open through a comparatively small angle.

The object of the present invention, then, is to provide a clamp of the type mentioned in the introduction in which, along with a straightforward mechanical construction, the clamp legs can be moved back and forth reliably and precisely between the closed position and the open position and, in the process, can be pivoted about a considerably larger angle than a clamp according to the prior art.

This object is achieved by a clamp according to claim 1.

The actuating device which, in one end position, presses the clamp legs against one another in their closed position causes, upon movement into its other end position by means of the spreading element, the clamp leg or legs to be pivoted in a controlled manner into the open position. The movement of the clamp legs from the closed position into the open position and also vice versa is thus actively controlled by the actuating device alone, without additional elements being necessary for this purpose. The possibility of actively moving the clamp legs in two opposite directions allows the two clamp legs to be caused to execute a controlled, precise closing or opening movement at a certain point in time, in particular in order to release an article at a precise location with simultaneous movement of the clamps. Since, in the closed position, the clamp legs cross one another adjacent to the bearing spindle, the clamp legs can be pivoted about a very large angle during opening.

Since, in the case of the clamp according to the invention, an opening and closing movement can be produced by a single actuating device which is moved in a translatory manner and of which the structural configuration is not subject to any stringent requirements, it is possible for the clamps to be designed easily and cost-effectively in a manner which particularly reduces weight, the materials used and the amount of space required.

Preferred developments of the clamps according to the invention are described in dependent claims 2–6.

A conveying apparatus equipped with clamps according to the invention forms the subject matter of claim 7. Specific developments of this conveying apparatus are defined in dependent claims 8–13.

Figure 1:
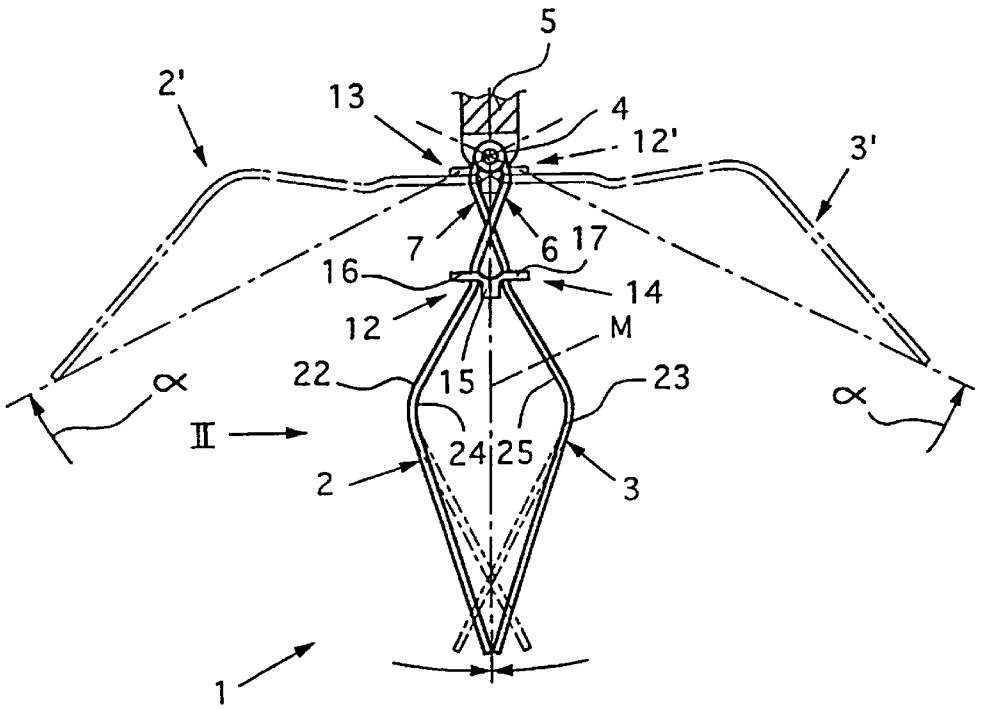
Figure 3:
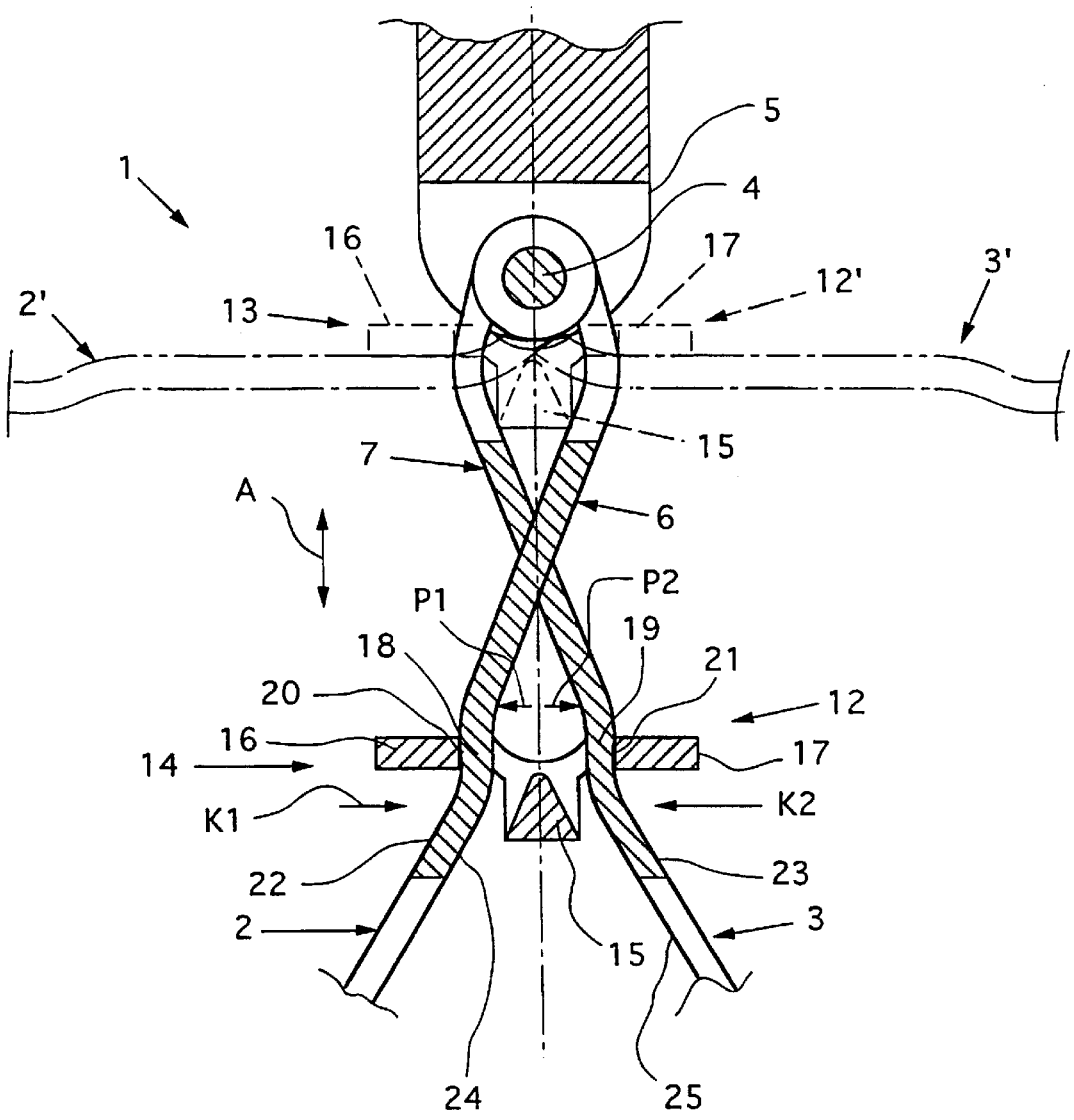
Figure 4:
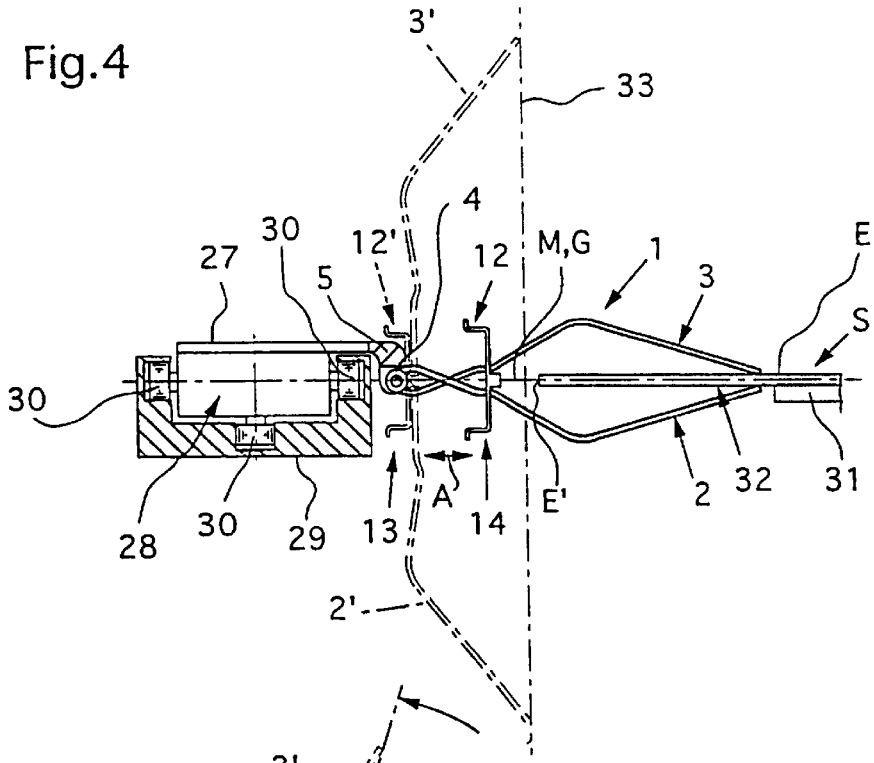
Figure 6:
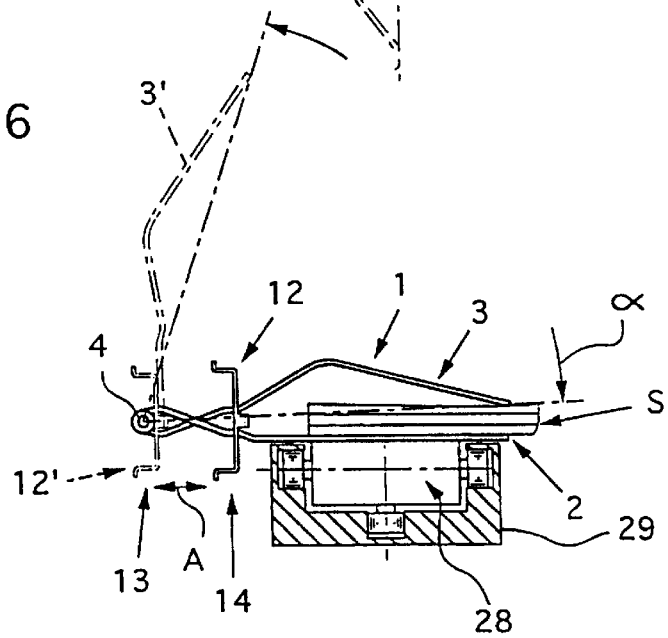

Exemplary embodiments of a clamp according to the invention and of conveying apparatuses according to the invention are described in more detail hereinbelow with reference to the drawings, in which, purely schematically:

FIG. 1 shows a side view of a clamp for retaining sheet-like articles,

FIG. 2 shows a view in the direction of the arrow II depicted in FIG. 1, FIG. 3 shows, on a scale which is larger than that in FIGS. 1 and 2, a side view, partially in section, of the top region of the clamps shown in FIGS. 1 and 2, FIG. 4 shows a side view, partially in section, of a conveying apparatus equipped with clamps according to FIGS. 1–3, FIG. 5 shows a plan view of the conveying apparatus according to FIG. 4, FIG. 6 shows, in an illustration corresponding to FIG. 4, a second embodiment of a conveying apparatus having clamps according to FIGS. 1–3, FIG. 7 shows a side view, partially in section, of a third embodiment of a conveying apparatus having clamps according to FIGS. 1–3, and FIG. 8 shows a plan view of said third embodiment.

First of all, the construction of a clamp 1 designed according to the invention will be described with reference to FIGS. 1–3.

This clamp 1 has two clamp legs 2, 3 which are of equal length and are mounted pivotably on a bearing spindle 4 such that they can be rotated individually. The pivot axis of the two clamp legs 2, 3 is designated 4*a* in FIG. 2. The bearing spindle 4 is mounted in a bearing part 5. For the purpose of mounting the clamp legs 2, 3, link plates 8 and 9 (FIG. 2) are respectively formed on the end parts 6 and 7 of the clamp legs, said link plates engaging around the bearing spindle 4 and being arranged alternately in the longitudinal direction thereof. As FIGS. 1–3 show, the two end parts 6, 7 of the clamp legs 2, 3 cross one another, i.e. the link plates 8 of the end part 6 pass through the end part 7 of the other clamp leg 3 and vice versa. This configuration and arrangement of the end parts 6, 7 of the clamp legs 2, 3 make it possible for the two clamp legs 2, 3 to be pivoted away from one another about a very large angle, as will be described in more detail. In the bottom region, adjoining the end parts 6, 7, the clamp legs 2, 3 may be provided with an opening 10 (FIG. 2), the shape and size of which also determine the elasticity behavior of the clamp legs 2, 3.

The two clamp legs 2, 3 can be pivoted back and forth between a closed position and an open or release position by means of an actuating device 12. FIGS. 1 and 3 use solid lines to illustrate the clamp legs 2, 3 located in the closed position. In contrast, the clamp legs 2, 3 located in the open position are indicated by chain-dotted lines, and respectively designated 2' and 3', in these figures. As can be seen from FIG. 1, in the closed position, the two clamp legs 2, 3 are symmetrical in relation to a center plane M. The elastic clamp legs 2, 3 are prestressed such that, in the closed position, their free ends subject the gripped article, not shown in FIGS. 1–3, to a clamping force. This is indicated in FIG. 1 by the clamp-leg ends illustrated by dashed lines, it being the case that these ends would cross one another in the closed position were they not in contact with one another.

The actuating device 12 can be displaced back and forth in a translatory manner in the direction of the arrow A between a first end position 13 and a second end position 14. In this case, the displacement direction A runs at right angles to the pivot axis 4*a* of the clamp legs 2, 3. The devices, e.g. cams, for the translatory displacement of the actuating device 12 are not shown in FIGS. 1–3. However, arrows C and D in FIG. 2 indicate the displacement forces which act on the actuating device 12 in order to move the latter from the first end position 13 into the second end position 14 and vice versa. This illustration clearly shows that the displacement forces C, D act on two opposite sides, in relation to the clamp legs 2, 3, this avoiding the situation where the clamps 1 are subjected to torques upon displacement of the actuating device 12. The location at which the end parts 6, 7 of the clamp legs 2, 3 cross one another in the closed position is located between the two end positions 13, 14 of the actuating device 12.

The actuating device 12 has a spreading element 15, which is arranged between the clamp legs 2, 3, and two closing elements 16, 17, which run on the outer sides of the clamp legs 2, 3. The spreading element 15 is fixed to the closing elements 16, 17. The clamp legs 2, 3 thus extend through between the spreading element 15 and in each case one of the closing elements 16, 17.

In order to secure the actuating device 12 against displacement in its second end position 14, the two clamp legs 2, 3 each have an angled section 18 and 19, respectively (FIG. 3). Each of these angled sections 18, 19 respectively forms a latching surface 20, 21, which is located on the outer side 22, 23 of the clamp legs 2 and 3, respectively.

If the actuating device 12 is located in the second end position 14, the clamp legs 2, 3 assume their closed position, in which, as has been mentioned, they subject the gripped article to a clamping action. In this case, the closing elements 16, 17 respectively apply a clamping force K1, K2 to the outer side 22, 23 of the associated clamp leg 2, 3 respectively (FIG. 3). In this second end position 14, the actuating device 12 is secured in its position by the latching surfaces 20, 21.

If the actuating device 12 is then displaced in the direction of the arrow A into the first end position 13, in which it is illustrated by chain-dotted lines and designated 12', then the spreading element 15 acts on the inner side 24, 25 of the clamp legs 2, 3, respectively, and thus subjects the latter to an opening force P1, P2, respectively (FIG. 3). This results in the clamp legs 2, 3 being reliably forced to pivot out of their closed position, about the angle $\alpha$ in each case (FIG. 1), into the open position 2', 3'. A large pivot angle $\alpha$ is possible because the clamp legs 2, 3 are each mounted rotatably and the end parts 6, 7 of the clamp legs 2, 3 cross one another, as has been mentioned, when the clamp 1 is closed. Since the closing elements 16, 17 are offset in the direction of the bearing spindle 4 in relation to the spreading element 15, as seen in the displacement direction A, said closing elements 16, 17 do not obstruct the clamp legs 2, 3 from spreading apart.

Since the clamp legs 2, 3 can be pivoted about a large angle $\alpha$, clamps of the type described with reference to FIGS. 1–3 are particularly suitable for use in conveying apparatuses which, for transporting formations of sheet-like articles, grip said formations in the region of one side border (or, if need be, both side borders). FIGS. 4–8 will now be used to explain different variants of such conveying apparatuses in more detail, corresponding parts having the same designations in FIGS. 4–8 as in FIGS. 1–3.

Figure 5:
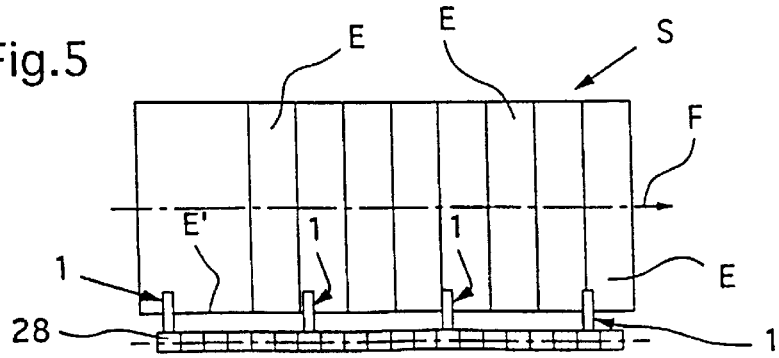

In the case of the conveying apparatus shown in FIGS. 4 and 5, the bearing parts 5 of each gripper 1 are connected to a fastening element 27, the bearing parts 5 preferably being formed integrally with the associated fastening element 27. The fastening elements 27 are fastened at regular intervals on a transporting means 28, which is merely schematically illustrated and is driven in the direction of the arrow F (FIG. 5) in a manner which is not shown. This conveying means is guided in a guide channel 29, for example by means of wheels 30. The conveying means 28 may be, for example, a drawing element, in particular a chain. Alongside this, the transporting means 28 may be formed by individual carriages which are guided in the guide channel 29 and are either connected to one another or separate from one another and drive one another in the conveying direction F by pushing forces. In the exemplary embodiment shown, the product formation S which is to be conveyed is formed by overlapping products E, which may be, for example, printed products containing one or more sheets. However, it is also possible for other flexible or flexurally rigid articles to be conveyed by the conveying apparatus shown. The product formation S, which in the present case is an imbricated formation, rests on a rest 31 in the region where it is received by the conveying apparatus. As soon as the clamps 1 have gripped the product formation S, such a rest 31 is no longer necessary.

As FIGS. 4 and 5 clearly show, the grippers 1 grip the product formation S in a region 32 which adjoins one side border E' of the products E, i.e. laterally. It can be seen from FIG. 4 that the grippers 1 are guided, at least in the receiving region, such that, in the closed position of the clamp legs 2, 3, the center plane M of the latter approximately coincides with the center plane G of the product formation S. This is achieved, on the one hand, by the transporting means 28 being guided in the guide 29 and, on the other hand, by the bearing spindles 4 being arranged parallel to the conveying direction F.

In FIG. 4, 33 indicates the plane which, in the open position of the clamp legs 2', 3', is defined by the free ends of the latter. This plane 33 is located outside the conveying path of the product formation S, which makes it easier for the product formation S and the conveying apparatus to be brought together laterally for the purpose of gripping the product formation S. Since, as has been mentioned, the clamp legs 2', 3' can be opened through a large angle, it is possible, when the product formation S is received, for the conveying apparatus to be advanced very closely up to the side edge E' of the product formation S. For this receiving operation, the product formation S does not have to be moved laterally relative to the clamps 1.

In the variant shown in FIG. 6, the clamps 1 are fastened directly on the conveying means 28 by one clamp leg 2. This means that, upon displacement of the actuating device 12 between the two end positions 13, 14, it is only the other clamp leg 3 which is pivoted through the angle $\alpha$.

Figure 7:
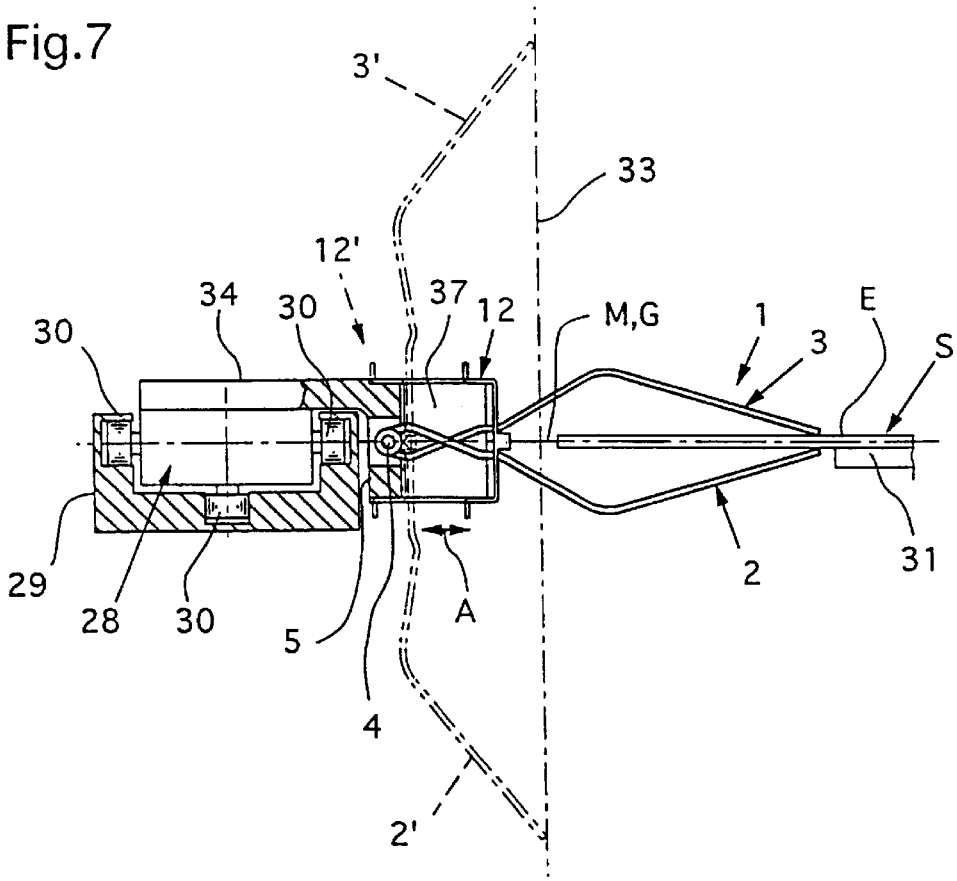
Figure 8:
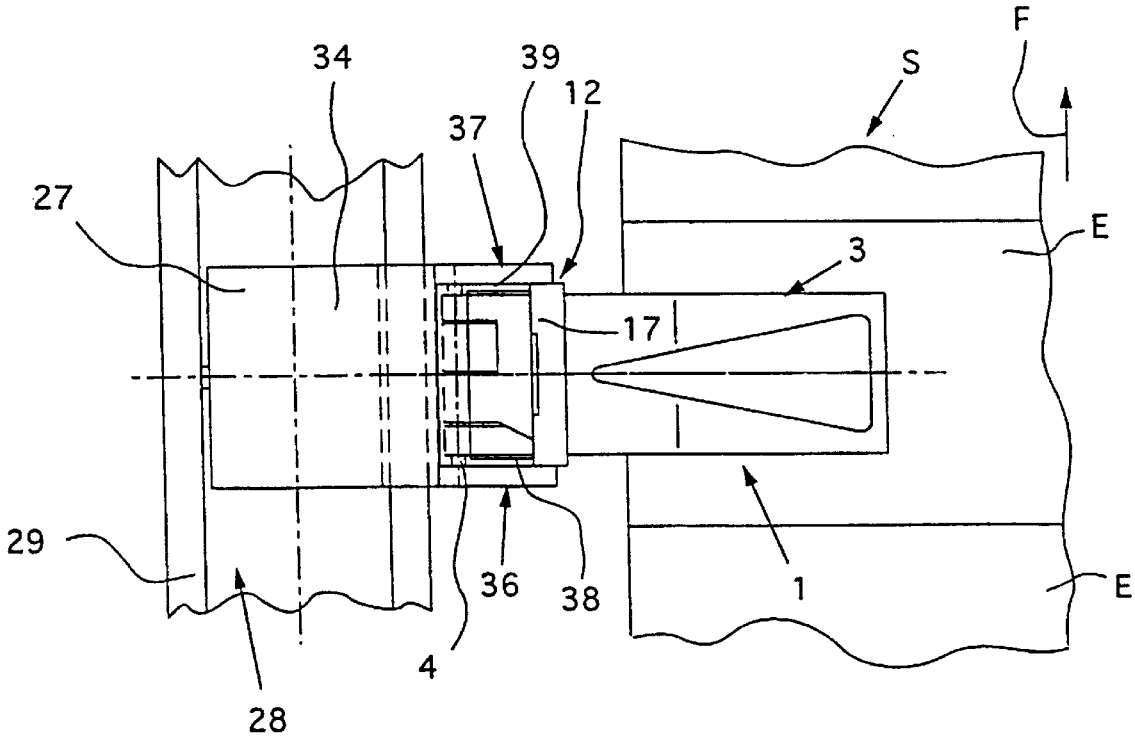

The embodiment shown in FIGS. 7 and 8 differs from that according to FIGS. 4 and 5 by way of a different design of the fastening element 34, by means of which a respective gripper 1 is fastened on the transporting means 28. This fastening element 34 is formed integrally with the bearing part 5 for the bearing spindle 4 and has two arms 36, 37 projecting away from it (FIG. 8). The two arms 36, 37 extend to the sides of the end parts 6, 7 of the clamp legs 2, 3 and each have a guide surface 38 and 39, respectively, for the actuating device 12. The actuating device 12 is thus guided laterally by said guide surfaces 38, 39, which run in the displacement direction A of the actuating device 12. In other words, the actuating device 12 rests on these guide surfaces 38, 39 by way of one closing element 17. This results, then, in the clamps 1 being retained in a stable position when closed, i.e. with the actuating device 12 located in the second end position 14. This means that the clamps 1 cannot rotate about the pivot axis 4*a* even when the product formation S is no longer resting on the rest 31. The center plane G of the product formation S and the center plane N of the closed clamps 1 thus coincide throughout the transporting operation. This allows straightforward three-dimensional guidance of the product formation S without high-outlay guide means being necessary.

Instead of, as is shown, using a single spreading element 15 which acts on both clamp legs 2, 3, the spreading element 15 may be of two-part design. In this case, in each case one of the two spaced-apart spreading-element parts is then assigned to one of the two clamp legs 2, 3. The single-part or two-part spreading element 15 need not necessarily extend over the entire width of the clamp legs 2, 3. It is also conceivable for the spreading element 15, instead of being configured as a continuous crosspiece as is shown, to be formed by two elongate spreading parts which each engage some way between the clamp legs 2, 3 and of which the ends are spaced apart opposite one another.

What is claimed is:

1. A clamp for retaining sheet-like articles (E), in particular flexible articles such as printed products containing one or more sheets, having two clamp legs (2, 3) which can be pivot relative to one another, are mounted individually on a common bearing spindle (4) and, in a closed position, subject the gripped article (E) to a clamping action, and having an actuating device (12) which can be moved in a translatory manner in a direction (A), which runs essentially at right angles to the bearing spindle (4), between a first end position (13), which allows the clamp legs (2, 3) to be opened, and a second end position (14), in which the clamp legs (2, 3) assume the closed position, it being the case that, in its second end position (14), the actuating device (12) subjects at least one clamp leg (2, 3) to a closing force (K1, K2) which presses the two clamp legs (2, 3) against one another, wherein the actuating device (12) has a spreading element (15) which is arranged between the two clamp legs (2, 3) and, upon movement of the actuating device (12) from the second end position (14) into the first end position (13), subjects the side (24, 25) at least of one clamp leg (2, 3), said side being directed toward the other clamp leg (2, 3), to an opening force (P1, P2) and thus pivots said at least one clamp leg (2, 3) out of the closed position into an open position, and wherein, in their closed position, the clamp legs (2, 3) cross one another between the bearing spindle (4) and the second end position (14) of the actuating device (12).

2. The clamp as claimed in claim 1, wherein, upon movement of the actuating device (12) from the second end position (14) into the first end position (13), the spreading element (15) subjects the two clamp legs (2, 3) to an opening force (P1, P2) and pivots the two clamp legs (2, 3) into the open position about an angle ($\alpha$).

3. The clamp as claimed in claim 1 or 2, wherein the actuating device (12) has two closing elements (16; 17), of which each runs on the outer side (22, 23) of one of the clamp legs (2, 3), acts on the associated clamp leg (2, 3) upon displacement of the actuating device (12) toward the second end position (14), and pivots said clamp leg toward the closed position and, with the actuating device (12) located in the second end position (14), subjects the associated clamp leg (2, 3) to a closing force (K1, K2).

4. The clamp as claimed in claim 3, wherein the closing elements (16, 17) are offset in the direction of the bearing spindle (4) in relation to the spreading element (15).

5. The clamp as claimed in claim 3, wherein, on its outer side (22, 23), each clamp leg (2, 3) has a latching surface (20, 21) with which the actuating device (12) interacts, preferably by way of the closing elements (16, 17), in the second end position (14).

6. The clamp as claimed in one of claim 1 or 2, wherein the end part (6, 7) of each clamp leg (2, 3), said end part being adjacent to the bearing spindle (4), is divided up into spaced-apart segments (8, 9) which are mounted on the bearing spindle (4) such that the segments (8) of one clamp leg (2) alternate with the segments (9) of the other clamp leg (3) in the direction of said bearing spindle (4).

7. A conveying apparatus which is intended for conveying a product formation (S) formed from sheet-like articles (E), in particular printed products, and has a number of clamps (1) which are arranged one behind the other in the conveying direction (F), are designed in accordance with one or more of claim 1 or and are connected to a transporting means (28) such that the bearing spindles (4) of the clamps (1) run essentially parallel to the conveying direction (F) and the clamps (1) are intended for acting on the region (32) of one side edge (E') of the product formation (S) which is to be conveyed.

8. The conveying apparatus as claimed in claim 7, wherein the bearing spindles (4) of the clamps (1) are mounted in a bearing part (5) which is connected to a fastening element (27, 34) which is fastened on the transporting means (28).

9. The conveying apparatus as claimed in claim 8, wherein the actuating devices (12) of the clamps (1) are guided by means of guides (36–39) which run in the movement direction (A) of the actuating devices (12).

10. The conveying apparatus as claimed in claim 9, wherein each guide is formed by two guide surfaces (38, 39) which extend on opposite sides of the clamp legs (2, 3) in the movement direction (A) of the actuating device (12).

11. The conveying apparatus as claimed in claim 10, wherein, in the closed position of the clamp legs (2, 3), the clamps (1) are retained, by means of the guides (36–39), in a position in which a clamp center plane (M) which contains the bearing spindle (4) coincides with the center plane (G) of the transported product formation (S).

12. The conveying apparatus as claimed in claim 7, wherein the clamps (1) are fastened on the transporting means (28) by way of one of their clamp legs (2, 3).

13. The conveying apparatus as claimed in one of claim 12 for conveying an imbricated formation (S) formed from overlapping sheet-like products (E).

* * * * *

UNITED STATES PATENT AND TRADEMARK OFFICE

CERTIFICATE OF CORRECTION

PATENT NO. : 6,290,227 B1
DATED : September 18, 2001
INVENTOR(S) : Walter Reist

It is certified that error appears in the above-identified patent and that said Letters Patent is hereby corrected as shown below:

Column 6,
Line 21, insert -- 2 -- after "or".

Signed and Sealed this

Eleventh Day of June, 2002

*Attest:*

*Attesting Officer*

JAMES E. ROGAN
*Director of the United States Patent and Trademark Office*